US008136628B2

(12) United States Patent
Nishizawa

(10) Patent No.: US 8,136,628 B2
(45) Date of Patent: Mar. 20, 2012

(54) EXHAUST SYSTEM FOR MOTORCYCLE

(75) Inventor: Kazuya Nishizawa, Shizuoka (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 285 days.

(21) Appl. No.: 12/429,961

(22) Filed: Apr. 24, 2009

(65) Prior Publication Data

US 2009/0313982 A1 Dec. 24, 2009

(30) Foreign Application Priority Data

Jun. 18, 2008 (JP) ..... 2008-158704
Mar. 12, 2009 (JP) ..... 2009-060164

(51) Int. Cl.
*F01N 1/04* (2006.01)
*F01N 1/10* (2006.01)

(52) U.S. Cl. ..... 181/250; 181/248; 181/249; 181/252; 181/256

(58) Field of Classification Search ..... 181/227, 181/228, 247, 248, 249, 250, 252, 256
See application file for complete search history.

(56) References Cited

U.S. PATENT DOCUMENTS 3,263,772 A 8/1966 Irwin et al.
5,633,482 A * 5/1997 Erion et al. ..... 181/282
5,718,045 A * 2/1998 Tsukahara et al. ..... 29/890.08
6,571,910 B2 * 6/2003 Storm ..... 181/264
2002/0134614 A1 * 9/2002 Chen ..... 181/252
2004/0089500 A1 * 5/2004 Lewis ..... 181/249

FOREIGN PATENT DOCUMENTS

EP 0831211 3/1998
EP 1852580 11/2007
JP 55125311 9/1980
JP 02061316 3/1990
JP 2006-307793 11/2006
JP 2007-231784 9/2007

OTHER PUBLICATIONS

European Search Report, Sep. 14, 2009, for European Patent App. No. 09 25 1568.

* cited by examiner

*Primary Examiner* — Jeremy Luks
(74) *Attorney, Agent, or Firm* — Dickstein Shapiro LLP

(57) ABSTRACT

An exhaust system for a motorcycle is configured to enhance output while maintaining a necessary noise level. The exhaust system includes an exhaust pipe connected to an engine, and a silencer connected to the exhaust pipe. The silencer includes a hermetically sealed outer cylinder and an inner cylinder disposed within the outer cylinder so as to extend along an axis of the outer cylinder. The outer cylinder has a front end portion connected to the exhaust pipe and a rear end portion opened toward the atmosphere. The inner cylinder includes a reduced diameter portion with a diameter which becomes smaller in the downstream direction, a throttle portion with a constant diameter, the throttle portion being connected to the reduced diameter portion, and an enlarged diameter portion connected to the throttle portion with a diameter which becomes larger in the downstream direction.

20 Claims, 7 Drawing Sheets

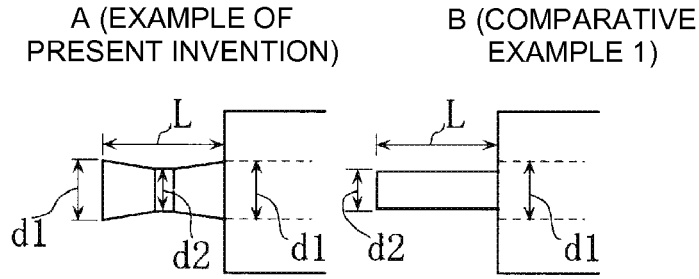
Fig. 5A
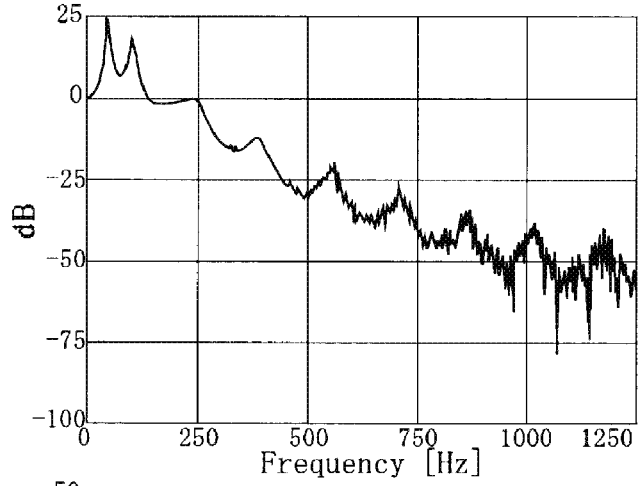
Fig. 5B
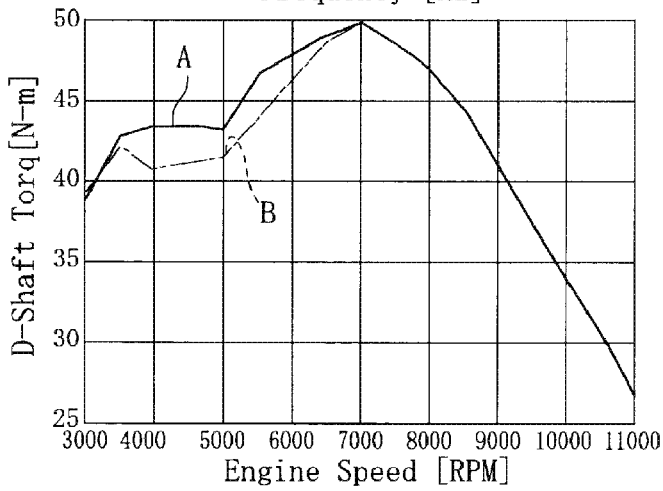
Fig. 5C
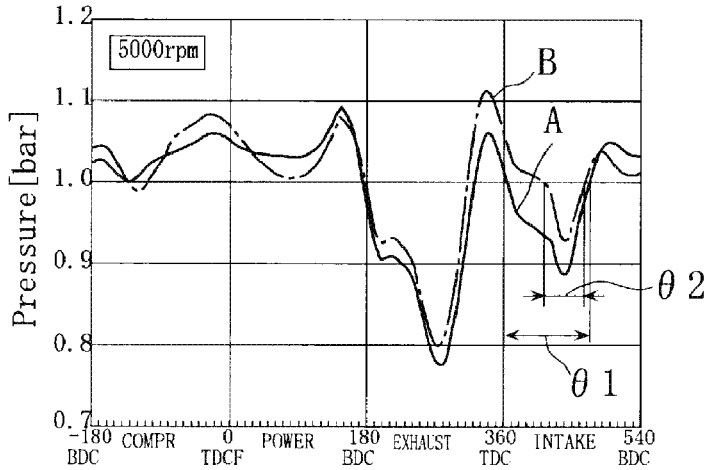

EXHAUST SYSTEM FOR MOTORCYCLE

PRIORITY INFORMATION

This patent application is based on and claims priority under 35 U.S.C. §119 to Japanese Patent Application No. 2008-158704, filed on Jun. 18, 2008, and Japanese Patent Application No. 2009-060164, filed on Mar. 12, 2009, the entire contents of which are hereby expressly incorporated by reference.

TECHNICAL FIELD

The present invention relates to an exhaust system for a motorcycle, and more particularly, to an exhaust system that is configured to enhance output while maintaining a necessary noise level.

BACKGROUND

In an exhaust system for a motorcycle, it is required to exhibit sufficient silencing effect to reduce noise. For example, Japanese Laid-Open Patent Application Publication No. 2006-307793 describes an exhaust system capable of enhancing the silencing effect. According to this conventional exhaust system, an outer cylinder and an inner cylinder constituting a muffler are gradually tapered rearward of a vehicle body, and a cross sectional area ratio of the inner and outer cylinders is substantially constant in the front/rear direction.

In the case of the conventional exhaust system, although the silencing effect can be enhanced, there is a problem that the engine output is reduced as the silencing effect is enhanced.

SUMMARY

The present invention has been accomplished in view of the conventional circumstances, and it is an object of the invention to provide an exhaust system for a motorcycle capable of enhancing output while maintaining a necessary noise level.

An exhaust system for a motorcycle of the present invention comprises an exhaust pipe connected to an engine, and a silencer connected to the exhaust pipe, characterized in that the silencer includes a hermetically sealed outer cylinder, and an inner cylinder disposed within the outer cylinder so as to extend along an axis of the outer cylinder, the inner cylinder having a front end portion connected to the exhaust pipe and a rear end portion opened toward the atmosphere. The inner cylinder includes a reduced diameter portion whose diameter becomes smaller in the downstream direction, a throttle portion with a constant diameter, which is connected to the reduced diameter portion, and an enlarged diameter portion which is connected to the throttle portion and whose diameter becomes larger in the downstream direction.

According to the exhaust system of the present invention, an outlet tube of the inner cylinder is constituted by the reduced diameter portion, the throttle portion and the enlarged diameter portion. Due to this, a necessary attenuation effect can be achieved by the throttle portion, and air intake can be increased by controlling a pressure wave in the exhaust pipe at the reduced diameter portion and the enlarged diameter portion. Therefore, the output can be enhanced while maintaining a necessary noise level. When the diameter of the throttle portion is uniform over the entire outlet tube, the attenuation effect is enhanced but the output is reduced. When the diameter of the entire tube is the same as that of the upstream end portion of the reduced diameter portion, the output can be enhanced but the noise level can not be lowered.

BRIEF DESCRIPTION OF THE DRAWINGS

FIGS. 5A-5C are characteristics diagrams showing results of experiments for explaining an effect of the structure of the invention.

DETAILED DESCRIPTION

Figure 1:
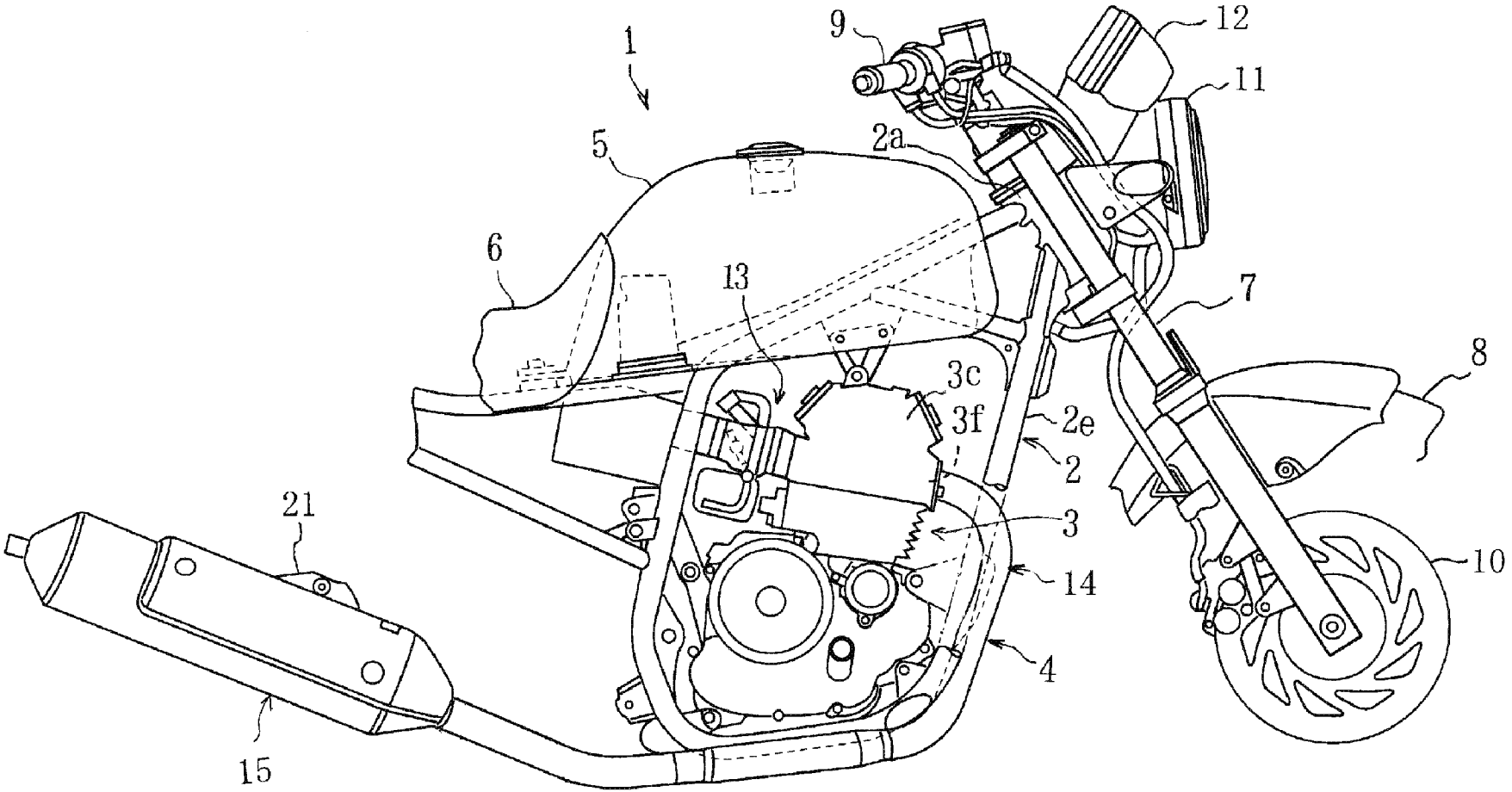
FIG. 1 is a right side view of a motorcycle according to a first embodiment of the present invention.

Embodiments of the present invention will be described based on the accompanying drawings.

FIGS. 1 to 4 are views for explaining an exhaust system for a motorcycle according to a first embodiment of the invention. In the embodiment, the terms "front," "rear," "left" and "right" mean front, rear, left and right, respectively as viewed from a person sitting on a seat of the motorcycle 1.

In the drawings, reference numeral 1 represents a motorcycle. The motorcycle 1 includes a body frame 2, an engine 3 mounted to the body frame 2, an exhaust system 4 connected to a front wall of the engine 3, a fuel tank 5 mounted to the body frame 2 above the engine, a seat 6 mounted to a rear side of the fuel tank 5, and an air intake apparatus 13 connected to a rear wall of the engine 3.

A front fork 7 is supported by a head pipe 2*a* on a front end of the body frame 2 such that the front fork 7 can be steered laterally, a front wheel 8 is pivotally supported on a lower end portion of the front fork 7, and a steering handle 9 is fixed to an upper end portion thereof. Reference numeral 10 represents a disk plate of a front wheel brake system. Reference numeral 11 represents a headlight, and reference numeral 12 represents a speedometer.

The exhaust system 4 includes an exhaust pipe 14 connected to an exhaust port 3*f* which opens toward a front wall of a cylinder head 3*c* of the engine 3, and a silencer 15 connected to a rear end portion of the exhaust pipe 14.

The exhaust pipe 14 extends downward from the exhaust port 3*f* while bending forward and downward between left and right downwardly extending tube portions 2*e* and 2*e*, and extends substantially horizontally rearward below the engine, and further extends diagonally rearward and upward.

The silencer 15 includes a hermetically sealed outer cylinder 16 and an inner cylinder 17 disposed within the outer cylinder 16. Reference numeral 21 represents a support bracket provided in the outer cylinder 16, and the silencer 15 is supported by the body frame 2 through the support bracket 21.

Figure 2:
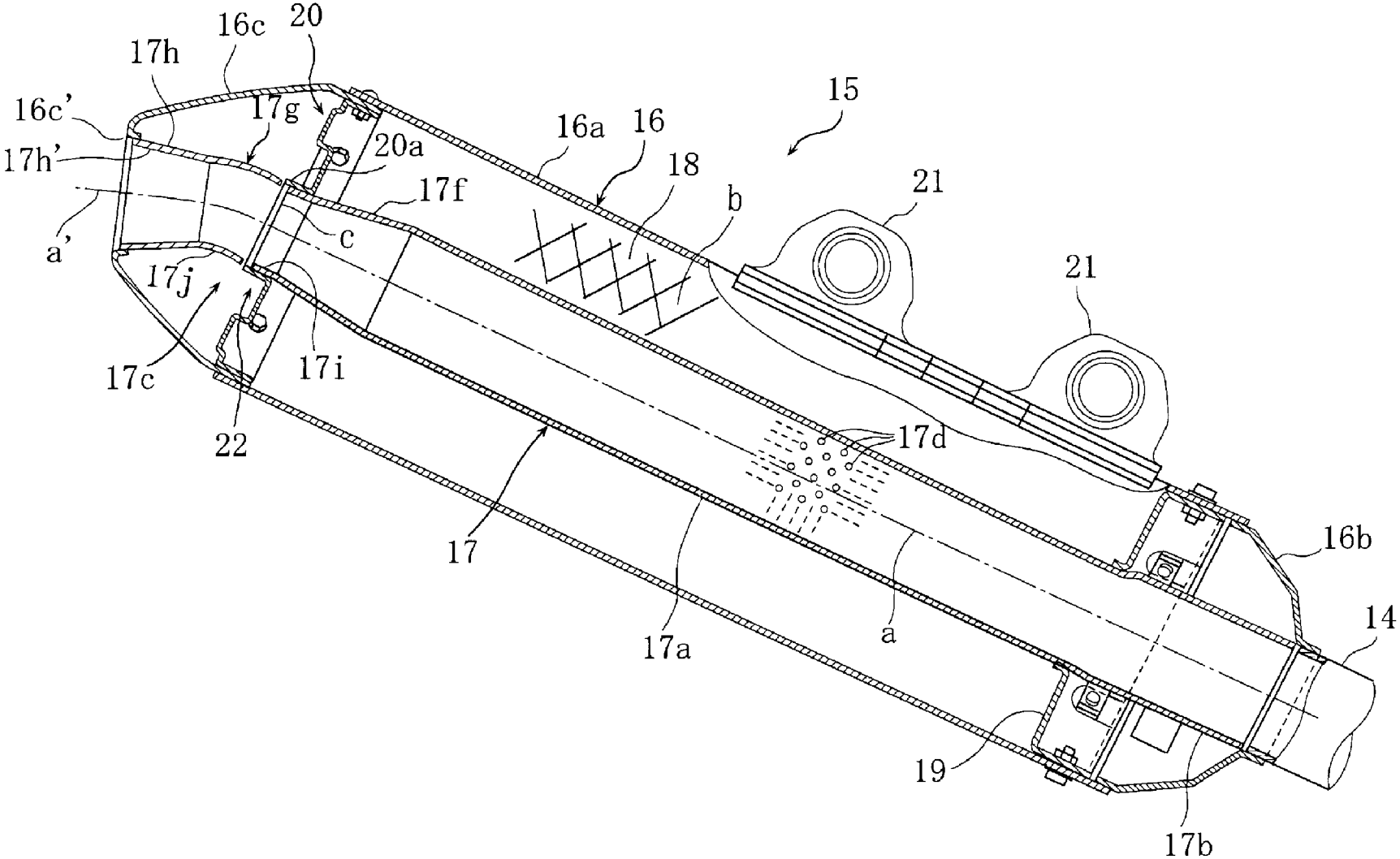
FIG. 2 is a sectional side view of a silencer according to the first embodiment.
Figure 3:
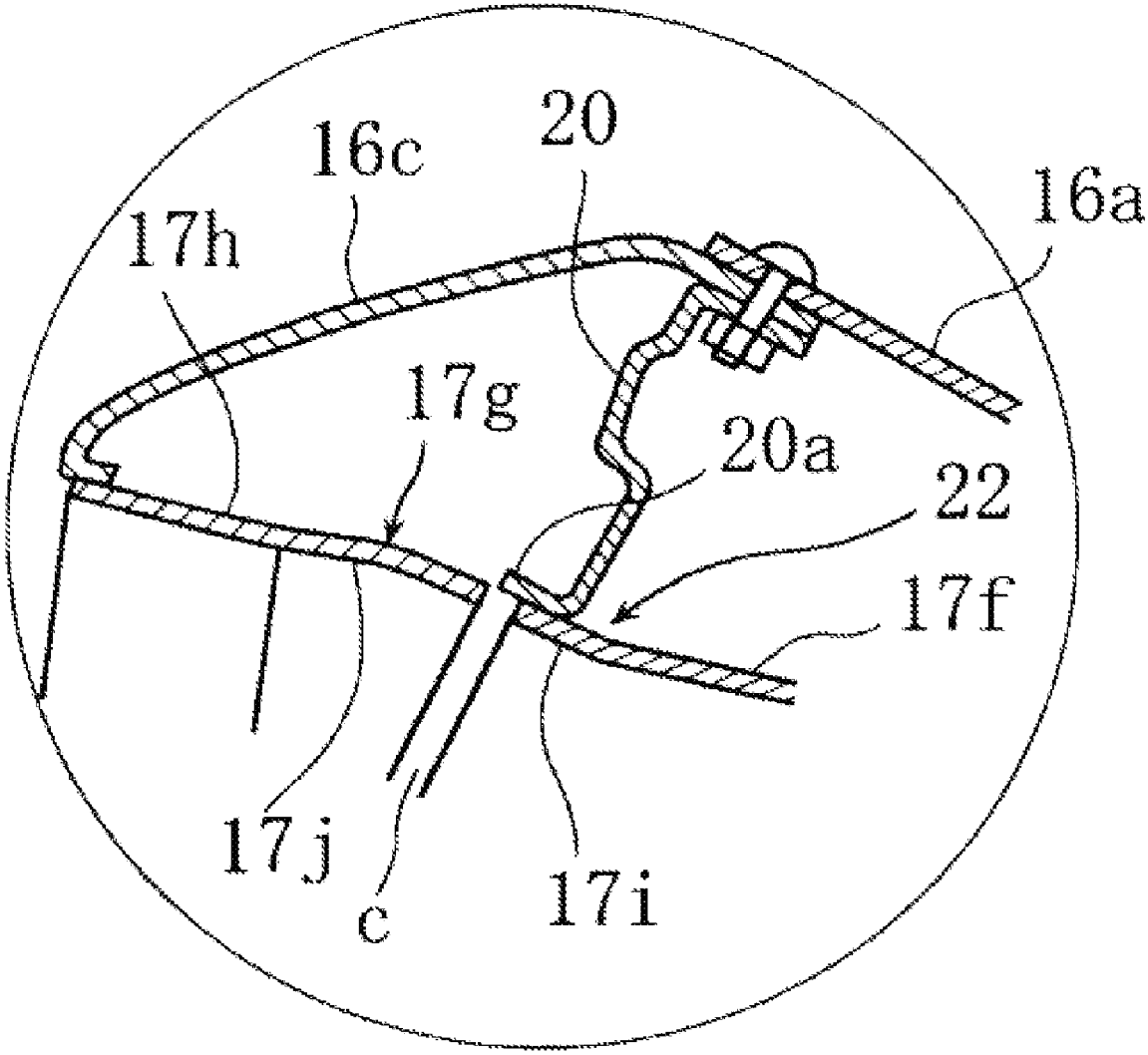
FIG. 3 is an enlarged view of a portion of the silencer of FIG. 2.
Figure 4:
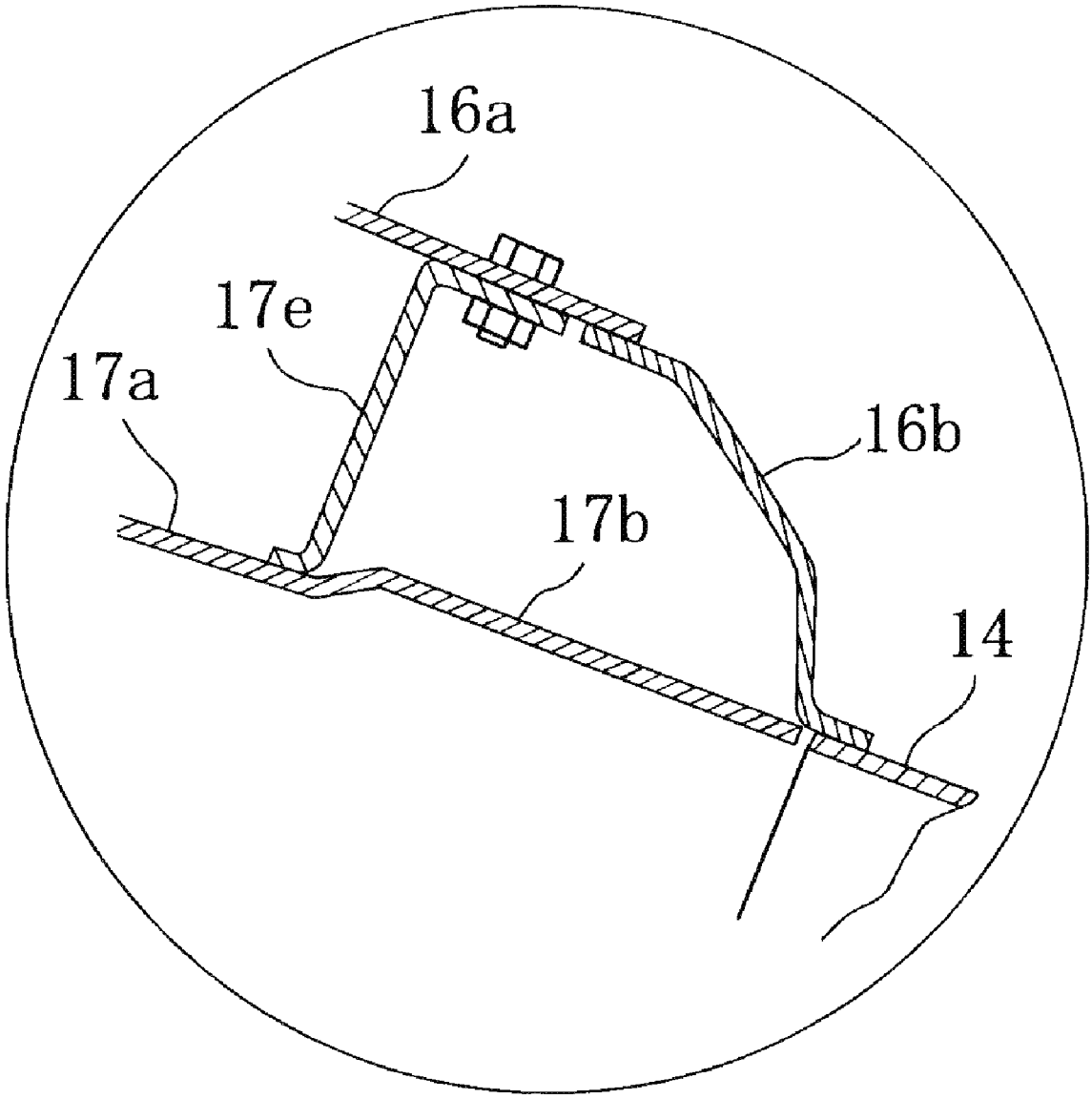
FIG. 4 is an enlarged view of another portion of the silencer of FIG. 2.

As schematically depicted in reference to FIG. 2, the outer cylinder 16 includes an outer cylinder main tube 16*a*, a front cover 16*b* connected to a front end portion of the outer cylinder main tube 16*a* such as to close the front end opening, and a rear cover 16*c* connected and fixed to a rear end portion of the outer cylinder main tube 16*a* such as to close the rear end opening. A front end portion of the front cover 16*b* is connected and fixed to a rear end portion of the exhaust pipe 14.

The inner cylinder 17 includes an inner cylinder main tube 17*a* disposed coaxially within the outer cylinder main tube 16*a* with a common longitudinal axis a, an inlet tube 17*b* connected to a front end portion of the inner cylinder main tube 17*a*, and an outlet tube 17*c* connected to a rear end portion thereof.

The inner cylinder main tube 17*a* is a porous straight tube formed from a so-called punched pipe having a large number of small-diameter holes 17*d* (FIG. 2). Exhaust gas moves through the small-diameter holes 17*d* into a space b formed between the inner cylinder main tube 17*a* and the outer cylinder main tube 16*a*. A sound absorbing material, e.g., glass wool 18 is stuffed in the space b.

The inlet tube 17*b* has a diameter slightly larger than that of the inner cylinder main tube 17*a*, and the inlet tube 17*b* is supported by a front end portion of the outer cylinder main tube 16*a* through a front support member 19. The inlet tube 17*b* is substantially connected to a rear end opening of the exhaust pipe 14.

The outlet tube 17*c* includes a reduced diameter portion 17*f* which is connected to a rear end of the inner cylinder main tube 17*a* and which is tapered so that it becomes smaller in diameter in the downstream direction, a throttle portion 17*g* which is connected to the reduced diameter portion 17*f* and which has a constant diameter, and an enlarged diameter portion 17*h* which is connected to the throttle portion 17*g* and which has a diameter that increases in the downstream direction.

The throttle portion 17*g* has a straight tube portion 17*i* and a bent tube portion 17*j*. By providing this bent tube portion 17*j*, a longitudinal axis a' of the enlarged diameter portion 17*h* is directed at a lower slope than the axis a of the inner cylinder main tube 17*a* in a state where the exhaust system is mounted on the vehicle. More specifically, the axis a' of the enlarged diameter portion 17*h* is directed so that axis extends below the horizon in the rearward direction. The axis a' of the enlarged diameter portion 17*h*, however, can be directed to the horizon or higher than the horizon.

The straight tube portion 17*i* is slidably supported by a cylindrical support portion 20*a* of a rear support member 20. Further, the bent tube portion 17*j* is fitted and inserted into the support portion 20*a*, and welded thereto. The rear support member 20 is fixed to the inner surface of outer cylinder main tube 16*a*. Further, a gap c is provided between the straight tube portion 17*i* and the bent tube portion 17*j*. Accordingly, an absorbing mechanism 22 which absorbs the difference in thermal expansion between the inner cylinder 17 and the outer cylinder 16 is constituted.

A rear end opening 17*h*' of the enlarged diameter portion 17*h* is disposed within a rear end opening 16*c*' of the rear cover 16*c* so as to face in a rearward direction. The peripheral edges of both openings 17*h*' and 16*c*' are fixed.

In other words, a portion of the outlet tube 17*c* projects rearward from the rear support member 20, which closes the rear end opening of the outer cylinder main tube 16*a*, and this projecting portion is surrounded by the rear cover 16*c* which is connected to the outer cylinder main tube 16*a*.

In the first embodiment, since the outlet tube 17*c* includes the reduced diameter portion 17*f*, the throttle portion 17*g* and the enlarged diameter portion 17*h*, it is possible to enhance the output while maintaining the necessary noise level. That is, by setting the diameter of the throttle portion 17*g*, a necessary attenuation effect can be obtained. Since the reduced diameter portion 17*f* and the enlarged diameter portion 17*h* are provided in front of and behind the throttle portion 17*g*, respectively, it is possible to control a pressure wave in the exhaust pipe by setting diameters and lengths of the reduced diameter portion 17*f* and the enlarged diameter portion 17*h* accordingly, whereby the air intake can be increased and as a result, the output can be enhanced while maintaining a necessary noise level.

Since the enlarged diameter portion 17*h* is constituted such that its axis a' is directed so that it extends below the horizon in the rearward direction, it is possible to prevent exhaust gas from being discharged directly to a motorcycle to the rear of motorcycle 1.

Since the enlarged diameter portion 17*h* is directed downward by bending the throttle portion 17*g*, which has constant diameter, the exhaust system can be manufactured easily. When the manufactured reduced diameter portion 17*f* or a connected portion between the reduced diameter portion 17*f* and the throttle portion 17*g* is bent, however, the exhaust system can not be produced easily.

In this embodiment, the throttle portion 17*g* is formed by disposing the straight tube portion 17*i* and the bent tube portion 17*j* opposite each other with a gap c therebetween. The absorbing mechanism 22 is constituted by slidably supporting the straight tube portion 17*i* by the rear support member 20. Therefore, the difference between thermal expansion amounts of the outer cylinder 16 and the inner cylinder 17 caused by the temperature difference therebetween can be absorbed, and the enlarged diameter portion 17*h* can be directed lower than the horizon at the same time.

FIG. 5 show results of experiments for explaining the effect of the apparatus of the present invention. FIG. 5A shows frequency—attenuation characteristics, FIG. 5B shows engine speed—output shaft torque characteristics, and FIG. 5C shows crank angle—pressure characteristics.

In FIGS. 5A-5C, characteristic curves A and B show characteristics of the outlet tube A (example of the present invention) and an outlet tube B (comparative example 1). In the outlet tube A, a diameter of a connection between the reduced diameter portion 17*f* and the inner cylinder main tube 17*a* is d1, a diameter of the throttle portion 17*g* is d2, a diameter of a rear end opening of the enlarged diameter portion 17*h* is d1, and a length is L. The outlet tube B is a straight tube in which a diameter of a connection between the outlet tube B and the inner cylinder main tube 17*a* and a diameter of its downstream end are d2, and a length is L.

In the attenuation characteristics, both outlet tubes A and B have substantially the same attenuation characteristics (FIG. 5A). In output shaft torque at intermediate speed rotation, the shaft torque of the outlet tube A is greater than the shaft torque of the outlet tube B (FIG. 5B). This is because in the case of the outlet tube A, a crank angle θ1, at which the pressure of the exhaust port in the intake stroke becomes negative, is greater than a crank angle θ2, at which the pressure in the outlet tube B becomes negative. Thus, the air intake increasing effect utilizing a pressure wave and charging efficiency are improved, and as a result, the shaft torque is increased.

Figure 6:
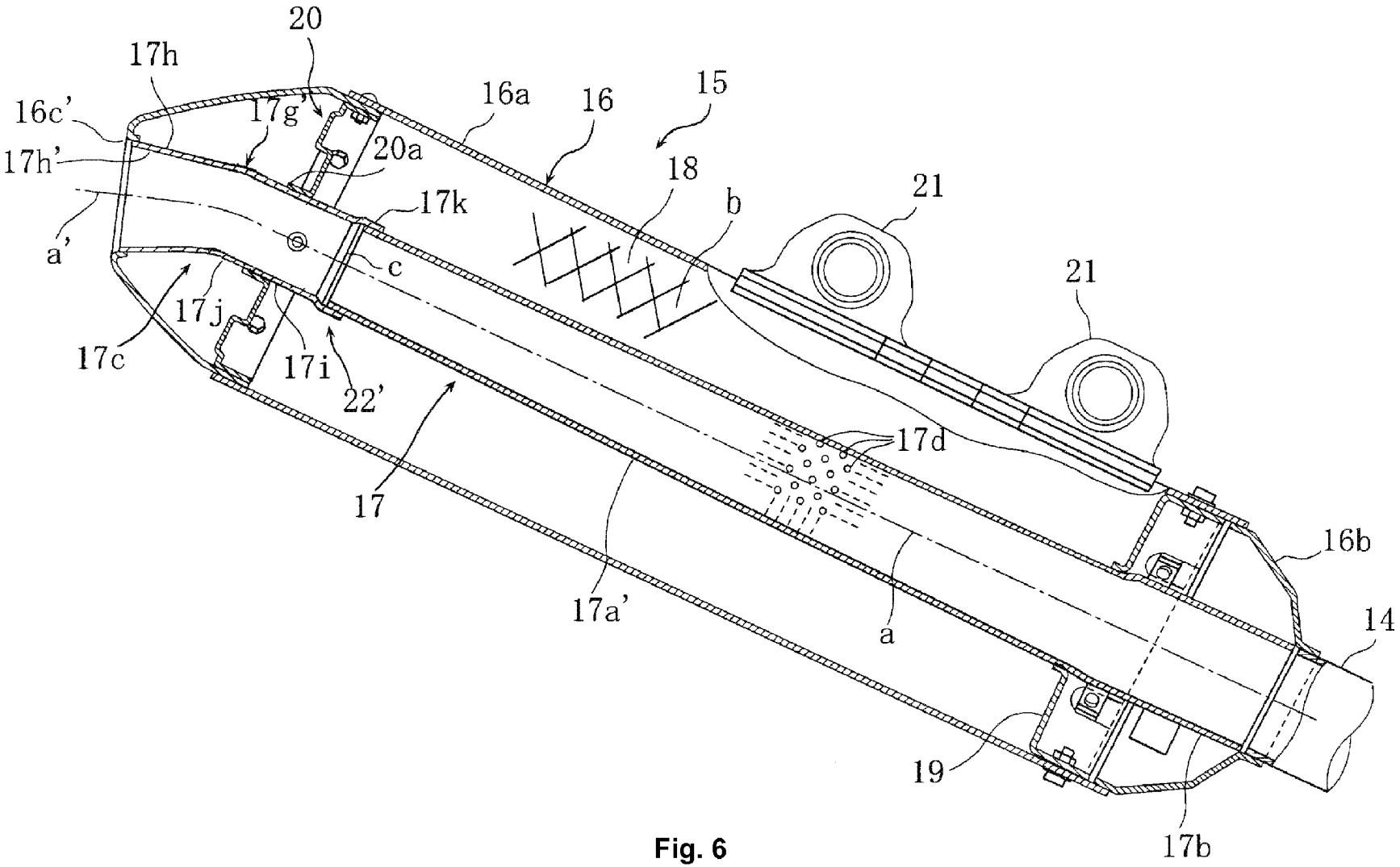
FIG. 6 is a sectional side view of a silencer according to a second embodiment of the invention.

FIG. 6 is a view for explaining a second embodiment of the present invention. In FIG. 6, the same numerals as those in FIG. 2 represent the same or equivalent elements.

In the second embodiment, the reduced diameter portion is constituted such that the inner cylinder main tube 17*a*' of the inner cylinder 17 is tapered so as to become smaller in the downstream direction over its entire length. In the throttle portion 17*g*', the straight tube portion 17*i* and the bent tube portion 17*j* are integrally connected to each other without a gap therebetween.

A gap c is provided between a downstream end of the tapered inner cylinder main tube 17*a*' and an upstream end of the straight tube portion 17*i* of the throttle portion 17*g*'. This gap c is covered by slidably inserting the downstream end portion of the inner cylinder main tube 17*a*' into a slide portion 17*k* formed on an edge of the upstream end of the straight tube portion 17*i*. Accordingly, an absorbing mechanism 22', which absorbs the difference in thermal expansion between the inner cylinder 17 and the outer cylinder 16, is constituted.

In the second embodiment, since the reduced diameter portion comprises the long inner cylinder main tube 17*a*', the diameter-reducing ratio is relatively gentle, the pressure loss caused by reducing the diameter becomes smaller, exhaust gas flows smoothly, and the reduced diameter portion contributes to enhancement of output.

Figure 7:
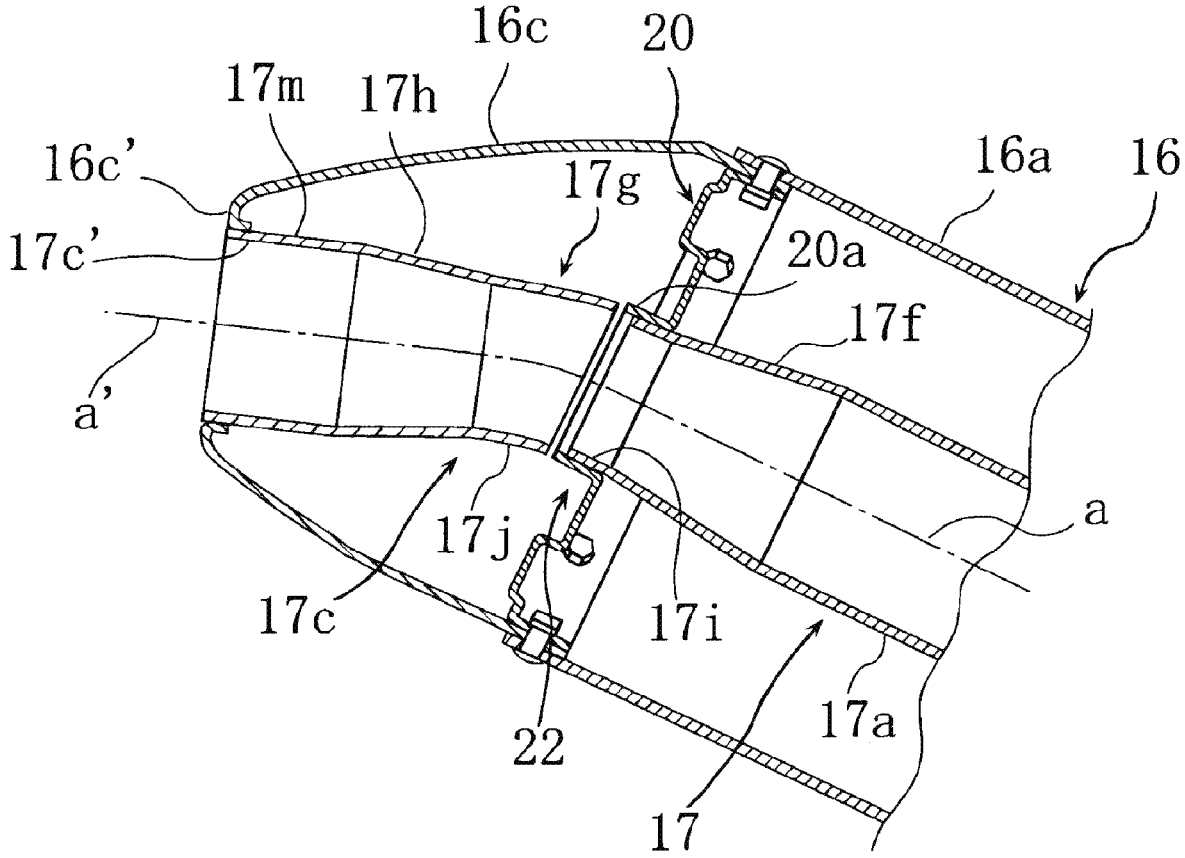
FIG. 7 is a sectional side view of a rear end portion of a silencer according to a third embodiment of the invention.

FIG. 7 is a schematic view for explaining a third embodiment of the invention, and the same numerals as those in FIG. 2 show the same or equivalent elements.

Although the rear end opening of the enlarged diameter portion 17*h* is opened directly toward the atmosphere in the first and second embodiments, a large-diameter straight tube 17*m* is further connected to a downstream end of the enlarged diameter portion 17*h* in the third embodiment. The diameter of the large-diameter straight tube 17*m* is set to be the same as that of a downstream end opening of the enlarged diameter portion 17*h*.

In this embodiment, since the large-diameter straight tube 17*m* is added, the exhaust sound can further be reduced without reducing the shaft torque.

It is to be clearly understood that the above description was made only for purposes of an example and not as a limitation on the scope of the invention as claimed herein below.

What is claimed:

1. An exhaust system for a motorcycle, comprising:
an exhaust pipe connected to an engine; and
a silencer connected to the exhaust pipe, the silencer comprising:
a hermetically sealed first tubular body; and
a second tubular body coaxially disposed within the first tubular body, the second tubular body having a front end portion connected to the exhaust pipe and a rear end portion opened toward the atmosphere, wherein the second tubular body includes an outlet tube, the outlet tube comprising a reduced diameter portion with a diameter which becomes smaller in the downstream direction, a throttle portion connected to the reduced diameter portion and having a constant diameter, and an enlarged diameter portion connected to the throttle portion, the enlarged diameter portion having a diameter which becomes larger in the downstream direction wherein the outlet tube further comprises a large-diameter straight tube connected to a downstream end of the enlarged diameter portion, the diameter of the large-diameter straight tube being equal to the diameter of the downstream end opening of the enlarged diameter portion.

2. The exhaust system of claim 1, wherein a rear end of the enlarged diameter portion opens toward the atmosphere.

3. The exhaust system of claim 1, wherein the second tubular body further includes a porous tube having a plurality of holes, the porous tube including an upstream end connected to the exhaust pipe and a downstream end connected to the reduced diameter portion.

4. The exhaust system of claim 3, further comprising a sound absorbing material operatively stuffed between the porous tube and the first tubular body.

5. The exhaust system of claim 1, wherein the length of the reduced diameter portion is substantially equal to the entire length of the first tubular body.

6. The exhaust system of claim 1, wherein the first tubular body includes a main tube portion, a rear cover connected to a rear end portion of the main tube portion, and a front cover connected to a front end portion of the main tube portion, and wherein at least a portion of the second tubular body projects outward from a downstream end of the main tube portion of the first tubular body, the projecting portion being surrounded by the rear cover.

7. The exhaust system of claim 1, wherein the silencer further comprises an absorbing mechanism which permits the first tubular body and the second tubular body to slide relative to one another to absorb the difference between thermal expansion amounts of the first and second tubular bodies caused by a temperature difference between the first tubular body and the second tubular body.

8. The exhaust system of claim 1, wherein a pressure wave in the exhaust pipe is controlled by setting corresponding diameters and lengths of the reduced diameter portion and the enlarged diameter portion.

9. The exhaust system of claim 6, wherein a rear end opening of the enlarged diameter portion is disposed within a rear end opening of the rear cover.

10. The exhaust system of claim 9, wherein the peripheral edges of the two rear end openings are fixed.

11. The exhaust system of claim 1, wherein the throttle portion includes a straight tube portion and a bent tube portion.

12. A motorcycle comprising the exhaust system of claim 1.

13. An exhaust system for a motorcycle, comprising:
an exhaust pipe connected to an engine; and
a silencer connected to the exhaust pipe, the silencer comprising:
a hermetically sealed first tubular body; and
a second tubular body coaxially disposed within the first tubular body, the second tubular body having a front end portion connected to the exhaust pipe and a rear end portion opened toward the atmosphere, wherein the second tubular body includes a reduced diameter portion with a diameter which becomes smaller in the downstream direction, a throttle portion connected to the downstream end of the reduced diameter portion and having a constant diameter, and an enlarged diameter portion connected to the downstream end of the throttle portion, the enlarged diameter portion having a diameter which becomes larger in the downstream direction, wherein the diameter of the upstream end of the enlarged diameter portion is equal to the constant diameter of the throttle portion, wherein the throttle portion is bent such that the longitudinal axis of the enlarged diameter portion is directed at a lower slope than a longitudinal slope of a main tube portion of the second tubular body in a state where the exhaust system is mounted on the motorcycle.

14. The exhaust system of claim 13, wherein the length of the reduced diameter portion is substantially equal to the entire length of a main tube portion of the first tubular body.

15. The exhaust system of claim 14, wherein the reduced diameter portion comprises a porous tube having a plurality of holes, the porous tube having a diameter that becomes smaller in the downstream direction.

16. The exhaust system of claim 15, wherein the silencer further comprises an absorbing mechanism which permits the first tubular body and the second tubular body to slide relative to one another to absorb the difference between thermal expansion amounts of the first and second tubular bodies caused by a temperature difference between the first tubular body and the second tubular body.

17. An exhaust system for a motorcycle, comprising:

an exhaust pipe connected to an engine; and a silencer connected to the exhaust pipe, the silencer comprising:

a hermetically sealed first tubular body; and a second tubular body coaxially disposed within the first tubular body, the second tubular body having a front end portion connected to the exhaust pipe and a rear end portion opened toward the atmosphere, wherein the second tubular body includes a reduced diameter portion with a diameter which becomes smaller in the downstream direction, a throttle portion connected to the downstream end of the reduced diameter portion and having a constant diameter, and an enlarged diameter portion connected to the downstream end of the throttle portion, the enlarged diameter portion having a diameter which becomes larger in the downstream direction, wherein the diameter of the upstream end of the enlarged diameter portion is equal to the constant diameter of the throttle portion, wherein the silencer further comprises an absorbing mechanism which permits the first tubular body and the second tubular body to slide relative to one another to absorb the difference between thermal expansion amounts of the first and second tubular bodies caused by a temperature difference between the first tubular body and the second tubular body, and wherein the throttle portion includes a straight tube portion connected to the reduced diameter portion and a bent tube portion connected to the enlarged diameter portion such that the bent tube portion is disposed opposite to the straight tube portion with a gap therebetween.

18. The exhaust system of claim 17, wherein the absorbing mechanism comprises a support member attached to the inner surface of the first tubular body and which slidably supports the straight tube portion.

19. An exhaust system for a motorcycle, comprising:

an exhaust pipe connected to an engine; and a silencer connected to the exhaust pipe, the silencer comprising:

a hermetically sealed first tubular body; and a second tubular body coaxially disposed within the first tubular body, the second tubular body having a front end portion connected to the exhaust pipe and a rear end portion opened toward the atmosphere, wherein the second tubular body includes a reduced diameter portion with a diameter which becomes smaller in the downstream direction, a throttle portion connected to the downstream end of the reduced diameter portion and having a constant diameter, and an enlarged diameter portion connected to the downstream end of the throttle portion, the enlarged diameter portion having a diameter which becomes larger in the downstream direction, wherein the diameter of the upstream end of the enlarged diameter portion is equal to the constant diameter of the throttle portion, wherein the throttle portion includes a straight tube portion and a bent tube portion, and wherein a gap is provided between the straight tube portion and the bent tube portion.

20. An exhaust system for a motorcycle, comprising:

an exhaust pipe connected to an engine; and a silencer connected to the exhaust pipe, the silencer comprising:

a hermetically sealed first tubular body; and a second tubular body coaxially disposed within the first tubular body, the second tubular body having a front end portion connected to the exhaust pipe and a rear end portion opened toward the atmosphere, wherein the second tubular body includes a reduced diameter portion with a diameter which becomes smaller in the downstream direction, a throttle portion connected to the downstream end of the reduced diameter portion and having a constant diameter, and an enlarged diameter portion connected to the downstream end of the throttle portion, the enlarged diameter portion having a diameter which becomes larger in the downstream direction, wherein the throttle portion includes a straight tube portion connected to the reduced diameter portion and a bent tube portion connected to the enlarged diameter portion such that the bent tube portion is disposed opposite to the straight tube portion with a gap therebetween, wherein the gap is formed around an axis of the second tubular body so that the downstream end of the straight tube portion and the upstream end of the bent tube portion face each other on opposing sides of the gap.

* * * * *